US009159276B2

(12) United States Patent
Malina et al.

(10) Patent No.: US 9,159,276 B2
(45) Date of Patent: Oct. 13, 2015

(54) METHOD FOR CREATING BIT PLANES USING A DIGITAL SIGNAL PROCESSOR AND DOUBLE INDEX ADDRESSING DIRECT MEMORY ACCESS

(75) Inventors: James N. Malina, Dallas, TX (US); Leonardo W. Estevez, Rowlett, TX (US); Gunter Schmer, Wylie, TX (US)

(73) Assignee: TEXAS INSTRUMENTS INCORPORATED, Dallas, TX (US)

( * ) Notice: Subject to any disclaimer, the term of this patent is extended or adjusted under 35 U.S.C. 154(b) by 1157 days.

(21) Appl. No.: 11/961,228

(22) Filed: Dec. 20, 2007

(65) Prior Publication Data

US 2009/0164666 A1 Jun. 25, 2009

(51) Int. Cl.

| | |
|---|---|
| ***G09G 3/34*** | (2006.01) |
| ***G09G 5/06*** | (2006.01) |
| ***G09G 5/393*** | (2006.01) |
| ***G09G 5/395*** | (2006.01) |

(52) U.S. Cl.

CPC ..... *G09G 3/346* (2013.01); *G09G 5/06* (2013.01); *G09G 5/393* (2013.01); *G09G 5/395* (2013.01); *G09G 2360/126* (2013.01)

(58) Field of Classification Search

CPC ..... G09G 5/022; G06F 7/76; G06F 7/768
USPC ..... 345/561, 562, 600–605
See application file for complete search history.

(56) References Cited

U.S. PATENT DOCUMENTS

| | | | | |
|---|---|---|---|---|
| 6,173,388 | B1 * | 1/2001 | Abercrombie et al. | 712/22 |
| 2005/0038910 | A1 * | 2/2005 | Zbiciak | 709/246 |

* cited by examiner

*Primary Examiner* — Aaron M Richer
(74) *Attorney, Agent, or Firm* — Robert D. Marshall, Jr.; Frank D. Cimino

(57) ABSTRACT

According to one embodiment of the present invention, a method for creating bit planes from frame data for a digital mirror device is disclosed including forming data elements comprising bits of equal significance from a plurality of pixel data in the frame data, the forming including using dual index direct memory address operations.

3 Claims, 8 Drawing Sheets

63 55 47 39 31 23 15 7 0
P7
P6-P1
P0
110
A7B7C7D7E7F7G7H7 I7J7K7L7M7N7O7P7 Q7R7S7T7U7V7W7X7
A0B0C0D0E0F0G0H0 I0J0K0L0M0N0O0P0 Q0R0S0T0U0V0W0X0
900
A7B7C7D7E7F7G7H7 A6B6C6D6E6F6G6H6 A5B5C5D5E5F5G5H5 A4B4C4D4E4F4G4H4 A3B3C3D3E3F3G3H3 A2B2C2D2E2F2G2H2 A1B1C1D1E1F1G1H1 A0B0C0D0E0F0G0H0
901
1001
A7B7C7D7E7F7G7H7 A5B5C5D5E5F5G5H5 A3B3C3D3E3F3G3H3 A1B1C1D1E1F1G1H1 A6B6C6D6E6F6G6H6 A4B4C4D4E4F4G4H4 A2B2C2D2E2F2G2H2 A0B0C0D0E0F0G0H0
902
1002
1003
A7A3B7B3D7D3E7E3 F7F3G7G3H7H3I7I3 A5A1B5B1C5C1D5D1 E5E1F5F1G5G1H5H1 A6A2B6B2C6C2D6D2 E6E2F6F2G6G2H6H2 A4A0B4B0C4C0D4D0 E4E0F4F0G4G0H4H0
903
1003
A7A5A3A1B7B5B3B1 C7C5C3C1D7D5D3D1 E7E5E3E1F7F5F3F1 G7G5G3G1H7H5H3H1 A6A4A2A0B6B4B2B0 C6C4C2C0D6D4D2D0 E6E4E2E0F6F4F2F0 G6G4G2G0H6H4H2H0
904
1004
A7A5A3A1B7B5B3B1 C7C5C3C1D7D5D3D1 A6A4A2A0B6B4B2B0 C6C4C2C0D6D4D2D0 E7E5E3E1F7F5F3F1 G7G5G3G1H7H5H3H1 E6E4E2E0F6F4F2F0 G6G4G2G0H6H4H2H0
905
A7A6A5A4A3A2A1A0 B7B6B5B4B3B2B1B0 C7C6C5C4C3C2C1C0 D7D6D5D4D3D2D1D0 E7E6E5E4E3E2E1E0 F7F6F5F4F3F2F1F0 G7G6G5G4G3G2G1G0 H7H6H5H4H3H2H1H0
1005
A A A

130

| 31 24 | 23 16 | 15 9 | 8 0 |
|---|---|---|---|
| A7A5B7B5C7C5D7D5 | E7E5F7F5G7G5H7H5 | A6A4B6B4C6C4D6D4 | E6E4F6F4G6G4H6H4 |

p7654H1

132

| 31 24 | 23 16 | 15 9 | 8 0 |
|---|---|---|---|
| I7I5J7J5K7K5L7L5 | M7M5N7N5O7O5P7P5 | I6I4J6J4K6K4L6L4 | M6M4N6N4O6O4P6P4 |

p7654H1

134

| 31 24 | 23 16 | 15 9 | 8 0 |
|---|---|---|---|
| A3A1B3B1C3C1D3D1 | E3E1F3F1G3G1H3H1 | A2A0B2B0C2C0D2D0 | E2E0F2F0G2G0H2H0 |

p3210H1

136

| 31 22 | 23 16 | 15 9 | 8 0 |
|---|---|---|---|
| I3I1J3J1K3K1L3L1 | M3M1N3N1O3O1P3P1 | I2I0J2J0K2K0L2L0 | M2M0N2N0O2O0P2P0 |

p3210L1

*FIG. 6*

140

| 31 24 | 23 16 | 15 9 | 8 0 |
|---|---|---|---|
| A7A6A5A4B7B6B5B4 | C7C6C5C4D7D6D5D4 | E7E6E5E4F7F6F5F4 | G7G6G5G4H7H6H5H4 |

p7654H2

142

| 31 24 | 23 16 | 15 9 | 8 0 |
|---|---|---|---|
| I7I6I5I4J7J6J5J4 | K7K6K5K4L7L6L5L4 | M7M6M5M4N7N6N5N4 | O7O6O5O4P7P6P5P4 |

p7654L2

144

| 31 24 | 23 16 | 15 9 | 8 0 |
|---|---|---|---|
| A3A2A1A0B3B2B1B0 | C3C2C1C0D3D2D1D0 | E3E2E1E0F3F2F2F0 | G3G2G1G0H3H2H1H0 |

p3210H2

146

| 31 22 | 23 16 | 15 9 | 8 0 |
|---|---|---|---|
| I3I2I1I0J3J2J1J0 | K3K2K1K0L3L2L1L0 | M3M2M1M0N3N2N1N0 | O3O2O1O0P3P2P1P0 |

p3210L2

*FIG. 7*

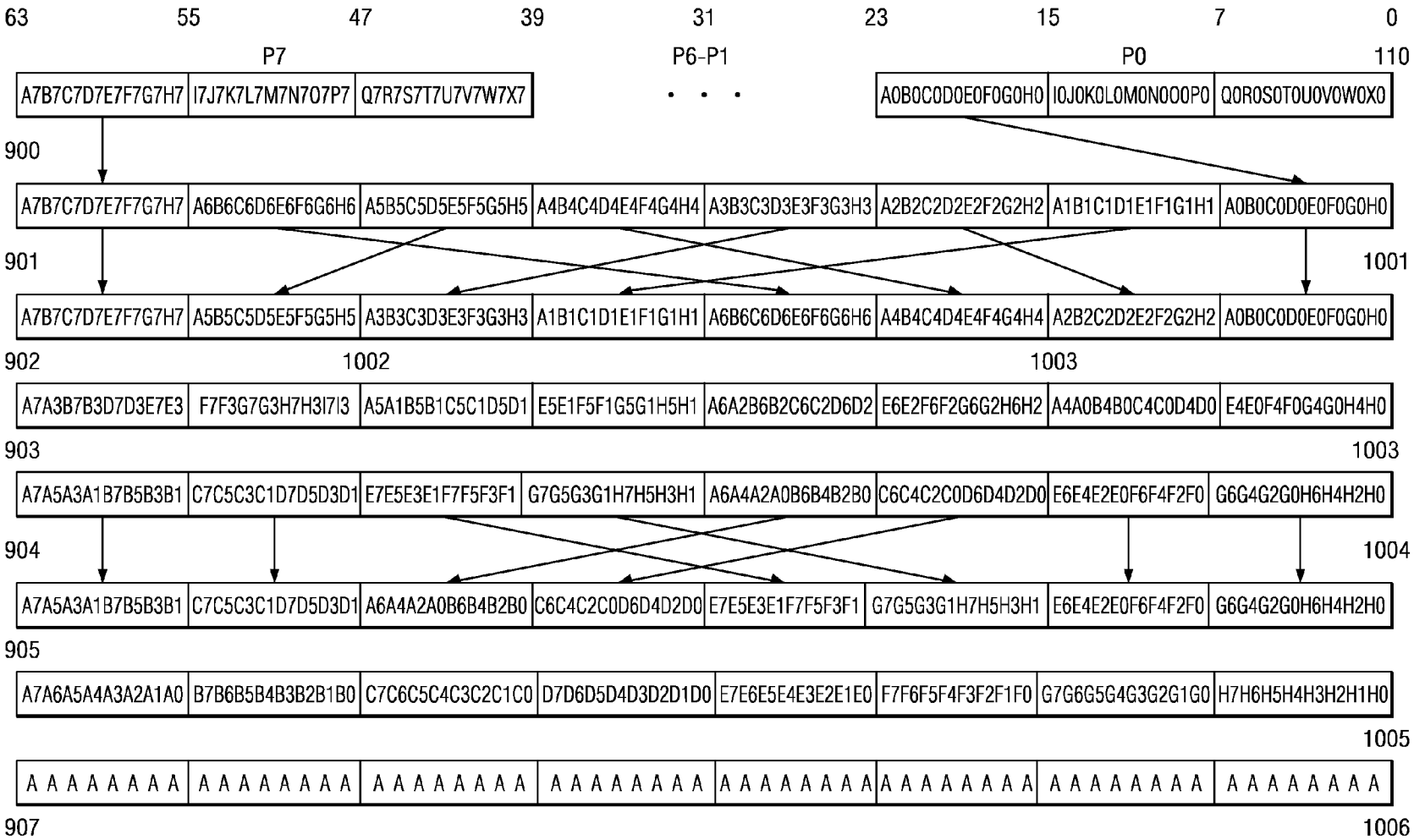
63
55
47
39
31
23
15
7
0
P7
P6-P1
P0
110
900
901
902
903
904
905
907
1001
1002
1003
1004
1005
1006
A7B7C7D7E7F7G7H7 I7J7K7L7M7N7O7P7 Q7R7S7T7U7V7W7X7
A0B0C0D0E0F0G0H0 I0J0K0L0M0N0O0P0 Q0R0S0T0U0V0W0X0
A7B7C7D7E7F7G7H7 A6B6C6D6E6F6G6H6 A5B5C5D5E5F5G5H5 A4B4C4D4E4F4G4H4 A3B3C3D3E3F3G3H3 A2B2C2D2E2F2G2H2 A1B1C1D1E1F1G1H1 A0B0C0D0E0F0G0H0
A7B7C7D7E7F7G7H7 A5B5C5D5E5F5G5H5 A3B3C3D3E3F3G3H3 A1B1C1D1E1F1G1H1 A6B6C6D6E6F6G6H6 A4B4C4D4E4F4G4H4 A2B2C2D2E2F2G2H2 A0B0C0D0E0F0G0H0
A7A3B7B3D7D3E7E3 F7F3G7G3H7H3I7I3 A5A1B5B1C5C1D5D1 E5E1F5F1G5G1H5H1 A6A2B6B2C6C2D6D2 E6E2F6F2G6G2H6H2 A4A0B4B0C4C0D4D0 E4E0F4F0G4G0H4H0
A7A5A3A1B7B5B3B1 C7C5C3C1D7D5D3D1 E7E5E3E1F7F5F3F1 G7G5G3G1H7H5H3H1 A6A4A2A0B6B4B2B0 C6C4C2C0D6D4D2D0 E6E4E2E0F6F4F2F0 G6G4G2G0H6H4H2H0
A7A5A3A1B7B5B3B1 C7C5C3C1D7D5D3D1 A6A4A2A0B6B4B2B0 C6C4C2C0D6D4D2D0 E7E5E3E1F7F5F3F1 G7G5G3G1H7H5H3H1 E6E4E2E0F6F4F2F0 G6G4G2G0H6H4H2H0
A7A6A5A4A3A2A1A0 B7B6B5B4B3B2B1B0 C7C6C5C4C3C2C1C0 D7D6D5D4D3D2D1D0 E7E6E5E4E3E2E1E0 F7F6F5F4F3F2F1F0 G7G6G5G4G3G2G1G0 H7H6H5H4H3H2H1H0
A A A

METHOD FOR CREATING BIT PLANES USING A DIGITAL SIGNAL PROCESSOR AND DOUBLE INDEX ADDRESSING DIRECT MEMORY ACCESS

TECHNICAL FIELD OF THE INVENTION

This disclosure relates in general to image display systems, and more particularly to a method for creating bit planes using a digital signal processor and direct memory access operations.

BACKGROUND OF THE INVENTION

A digital micromirror device (DMD), such as a Texas Instruments DLP™ micromirror device, can be used as part of an image projection system to create visual images using microscopically small mirrors laid out in a matrix on a semiconductor chip. Each mirror represents one or more pixels in a projected image. The number of mirrors corresponds to the resolution of the projected image. These mirrors can be repositioned rapidly to reflect light either through a lens or on to a heatsink. The data that is received by the DMD and that indicates the position of each of the mirrors at points in time is called a "bit plane." For example, consider an array filled with 1000 elements of 8-bit data. Each element can represent the position of a mirror or group of mirrors at a point in time. This array can be divided into eight 1000-bit arrays, the first of which would have all of bits for bit-position 0, the next would have all of the bits for bit-position 1, etc. Each of these eight 1000-bit arrays is a bit plane.

Image data from a video source often is not in bit-plane format. Image data from a video source may be in a frame by frame format, for instance. In order for a DMD to display frame data, the frame data must be converted into a bit-plane format. This conversion is called "corner turning." The term corner turning refers to the fact that the transformation from frame data to bit plane data resembles turning the frame data on a corner. The corner turn function can be accomplished by executing a code sequence in a DSP that converts a sequence of N bit numbers and produces a set of N bitmaps. The N bits of each number are generally stored together in a single storage unit such as a single memory location. Each bitmap contains one bit plane from the original data set.

The corner turning function can be a feature of a digital signal processor (DSP), a chip that can perform digital signal processing. In this context, the DSP formats data for the DMD by performing the "corner turn" function, which creates bit planes from frame data. A feature of some DSPs includes DSP operation codes (op-codes) that can be used to perform the corner turn function for DMD image projection systems.

Bit-plane oriented schemes usually make poor use of memory bandwidth. To read a given bit position across an entire data set, prior art schemes read the entire data set, extract the bit of interest and discard the other bits. This process must be repeated for each bit plane. These prior art schemes read about N times as much data as actually used for N-bit data elements.

Traditional solutions to planarization can only effectively process one bit-plane at a time. The straightforward implementation reads the data N times. Even if all N bit planes are extracted the first time the data is read, the extraction process usually operates only one bit at a time.

SUMMARY OF THE INVENTION

According to one embodiment of the present disclosure, a method for creating bit planes from frame data for a digital mirror device is disclosed. The method includes forming data elements comprising bits of equal significance from a plurality of pixel data in the frame data, the forming including using dual index direct memory address operations, the data elements giving the position of a mirror on a digital micromirror device.

In another embodiment, an integrated circuit comprising logic circuits operable to create bit planes from frame data, the frame data including a plurality of pixels, for a digital mirror device is disclosed. Bit planes are created from frame data by forming data elements comprising bits from the same position within each pixel, the forming including using dual index direct memory address operations.

Certain embodiments may provide a number of technical advantages. For example, a technical advantage of one embodiment may include the ability to corner turn specific frame data into an individual bit plane. This enables downstream algorithms to read only the data for the bit plane of interest. This greatly reduces the memory bandwidth bottleneck and opens many new optimization pathways. Another technical advantage of another embodiment is a reduction in the number of instructions required to perform corner turning. This would allow more memory or logic on a DSP to be dedicated to other uses.

Although specific advantages have been enumerated above, various embodiments may include all, some, or none of the enumerated advantages. Additionally, other technical advantages may become readily apparent to one of ordinary skill in the art after review of the following figures, description, and claims.

BRIEF DESCRIPTION OF THE DRAWINGS

To provide a more complete understanding of the present invention and features and advantages thereof, reference is made to the following description, taken in conjunction with the accompanying figures, wherein like reference numerals represent like parts, in which:

FIG. 6 illustrates the results of a SHFL or shuffle instruction.

FIG. 7 illustrates the results of a SHFL or shuffle instruction.

FIG. 10 illustrates a block diagram of a sequence of DMA and DSP instructions.

DETAILED DESCRIPTION OF EXAMPLE EMBODIMENTS

In one embodiment, the disclosure illustrates a sequence of one or more direct memory access (DMA), shift, pack, bitwise-shuffle, and dpack operations available on a Texas Instruments TMS320C64x/C64x digital signal processor (DSP) to facilitate a corner turn operation.

This disclosure describes embodiments that convert pixels in normal format or frame data format into data in bit plane format for a DMD system. The reason frame data must be converted to bit plane data in order to be displayed by a DMD system is because the pixel data in frame format contains all of the color data for each pixel in a contiguous piece for a moment in time. Thus, with frame data, red, blue, and green color data for a pixel for a moment in time is kept together in a single word of data. However, a DMD system must display each individual color for every pixel in the display at the same time. For example, a DMD system requires the red component for each pixel in the display at the same time, the blue component for each pixel at the same time, and the green component for each pixel at the same time Therefore, a bit plane comprising the individual color for each pixel at a particular moment in time must be created from the frame data, which has all colors for each pixel gathered together. This operation is the corner turn function discussed above.

Figure 1A:
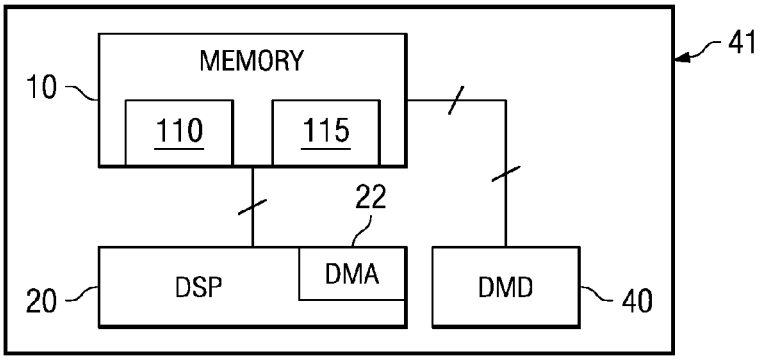
FIG. 1A illustrates an embodiment of a digital micromirror system.

FIG. 1A shows an embodiment of the present invention implemented in a DMD system. FIG. 1A shows a DMD system 41 containing a memory 10 coupled to a digital signal processor (DSP) 20 and a digital micromirror device (DMD) 40. DSP 20 contains a direct memory access (DMA) controller 22. In this example, memory 10 contains data structure 110 located in one area of memory 10 and data structure 115 located in a different area of memory 10. According to one embodiment of the present disclosure, data structure 110 is frame data that is read into DSP 20, converted to bit plane data, and written to a different part of memory 10 as data structure 115. The conversion of data structure 110 into data structure 115 is the corner turn function and is described in further detail with respect to FIG. 1B. Some embodiments of the present disclosure can be implemented in hard coded logic circuits in the DSP 20 or DMA 22, or in software code located in memory within the DSP 20 or DMA 22 or otherwise accessible to the DSP 20 and/or DMA 22, such as memory 10. FIG. 1A shows the frame data 110 residing in memory 10. Data in this format will not be properly displayed by a DMD because, as discussed above, DMD devices require all of the data for a single color for a particular instant in time to be grouped together. Instead, the frame data 110 contains the data of the three colors for each individual pixel as individual words. The data for a single color for a particular instant in time for all of the pixels in the display must be extracted from the frame data 110 in order for an image to be properly displayed by the DMD 40. Data in bit plane format for use by the DMD is shown as 115. The bit plane data 115 is the result of performing the corner turn function by the DSP and DMA on frame data 110.

Figure 1B:
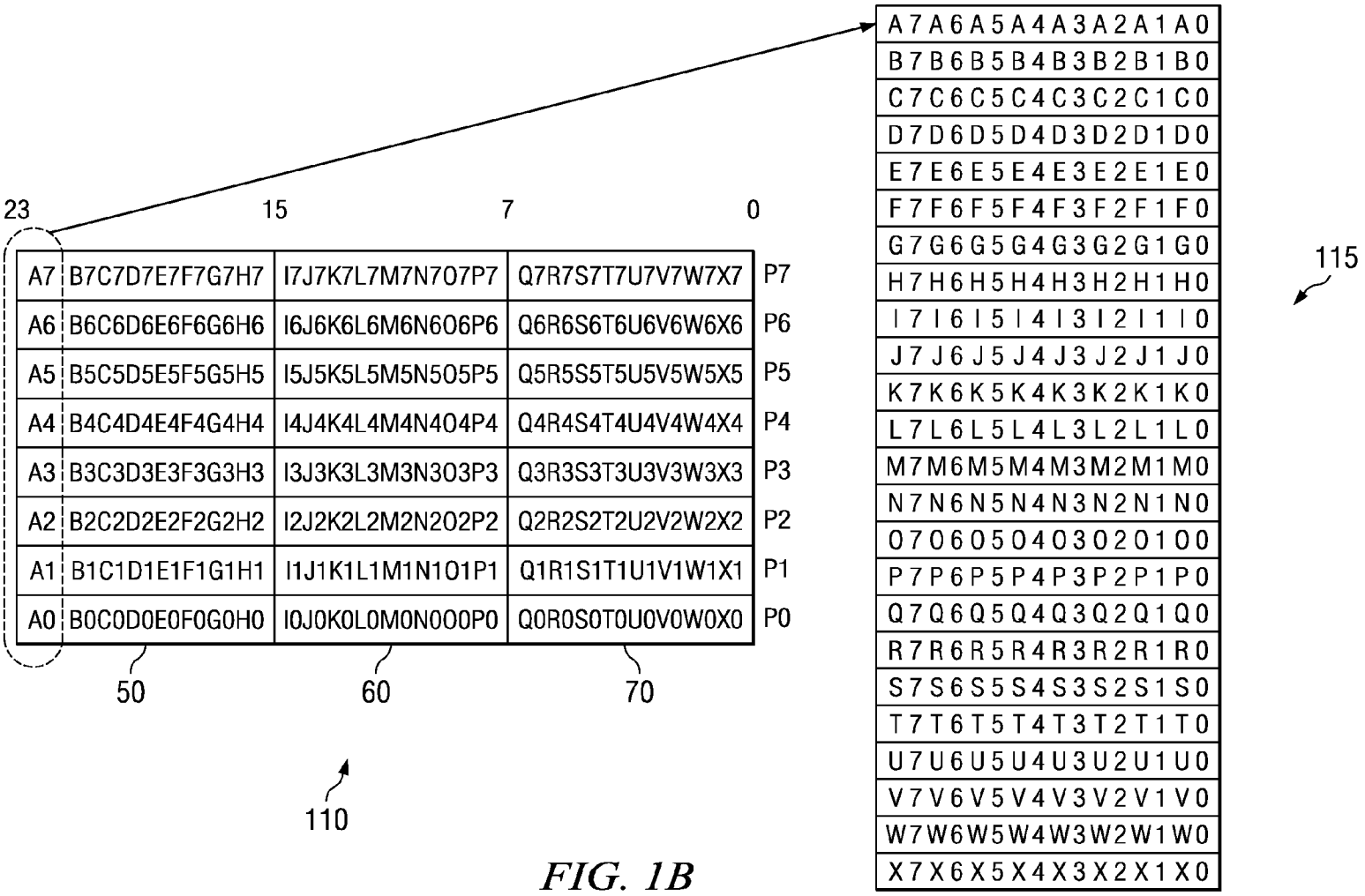
FIG. 1B illustrates the result of the corner turn operation on frame data.

FIG. 1B shows data structures 110 and 115 in memory 10 in more detail. Data structure 110 is frame data organized as 8 pixels, P7 to P0. Data structure 115 shows bit plane data and reflects the result of a corner turn operation on data 110. With respect to 110, each of rows P7 to P0 is a data for pixel. These 8 pixels each have 24 bits A through X. In this example, the 24 bits represent three colors, with the most significant 8-bits, A through H, representing red, the middle significant 8 bits, I through P, representing green, and the least significant 8-bits, Q through X, representing blue. Thus, column 50 of FIG. 1B shows the red data for pixels P7 to P0. Likewise, column 60 shows the green data for these pixels and column 70 shows the blue data. Data structure 110 illustrates the initial format of pixel data P7 to P0 as frame data in memory 10. Thus, each data word (shown as rows P7 to P0) consists of a pixel's red, green and blue color data. In addition, the numbers after each letter in 110 indicate the pixel the data is associated with. For example, A7 indicates the most significant bit for the data of pixel P7, and B7 represents the next most significant bit for pixel P7, and so on. Bit plane data 115 shows the result of the corner turn function on frame data 110. The most significant bit from each pixel P7 to P0 of 110 (shown as the circled column of 110 in FIG. 1B) now comprises the top row of data structure 115. The second row of 115 reflects the next most significant bit from each pixel of 110, and so on. According to the teachings of the present disclosure, the data is converted from the frame data format shown in 110 into the bit plane format shown in 115. Data structure 110 can reside in a storage device 10 as an array of 24 columns and 8 rows and can subsequently be converted, using the method of the present disclosure, to an array of 8 columns and 24 rows shown as 115 in a different location in the memory 10. After a corner turn is performed, the data 110 is transformed into an array of 8 columns and 24 rows 115, with each contiguous group of 8 rows containing all of data for an individual color in a frame. For instance, in this example, the rows beginning with A7 through H7 in 115 comprise the red pixel data for pixels P7 to P0 for a single frame. Thus, the data that was once column 50 in 110 representing red has been turned on its corner in 115 and comprises the first 8 rows of 115. Although FIG. 1B shows data for 8 pixels comprising 24-bit data words each, thousands of such words may reside in the memory of a DMD display device. One embodiment of the present disclosure may comprise performing corner turning for an HVGA resolution screen with 480 lines by 320 lines, or 153,600 pixel groups. Although this example operates on 8-bit data, the algorithm can be modified to work with smaller or larger data sizes. The most common pixel data sizes are 8 bits and 16 bits.

Figure 2B:
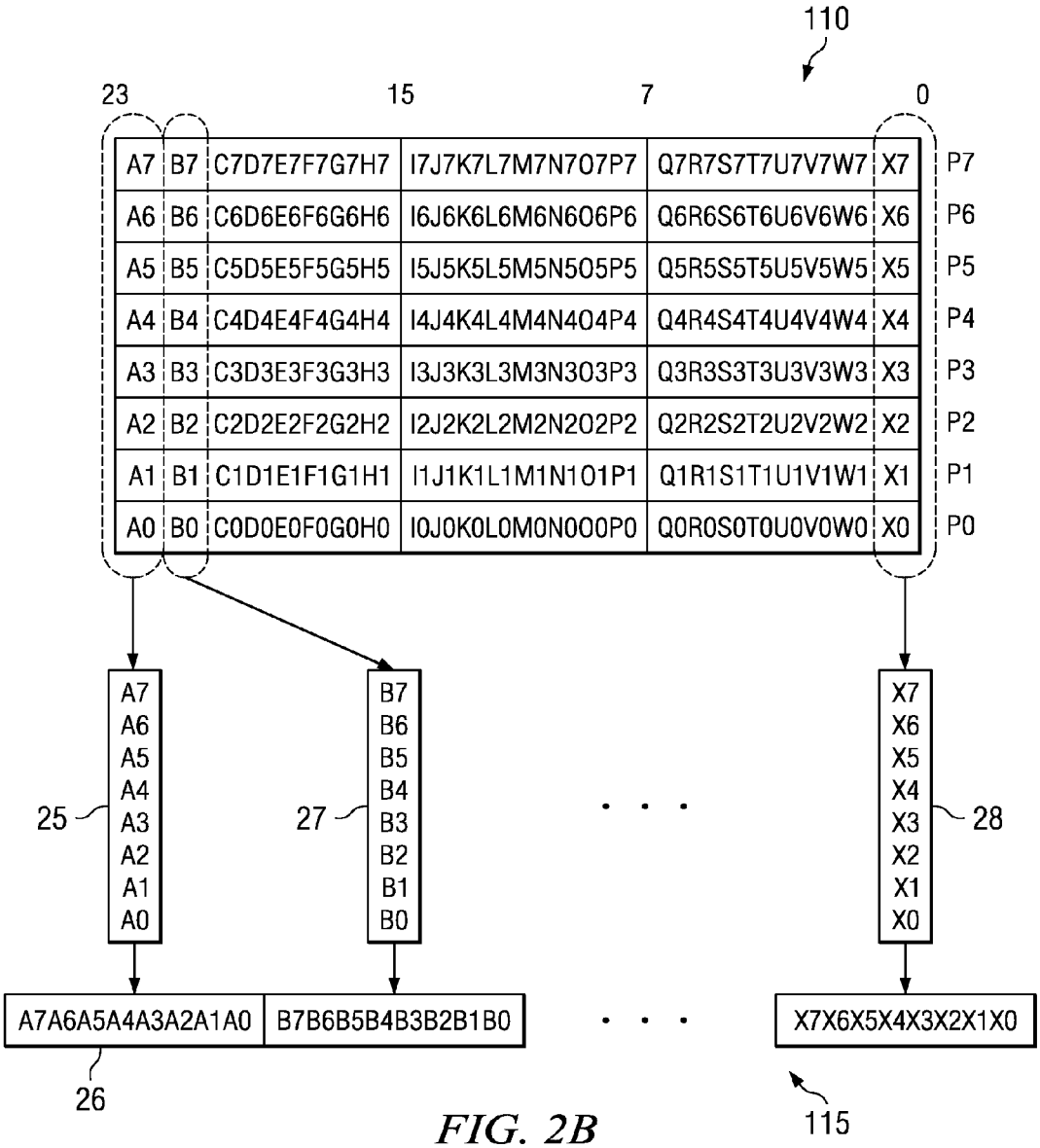
FIG. 2B illustrates the use of dual indexed direct memory access operations to perform the corner turn function.
Figure 2A:
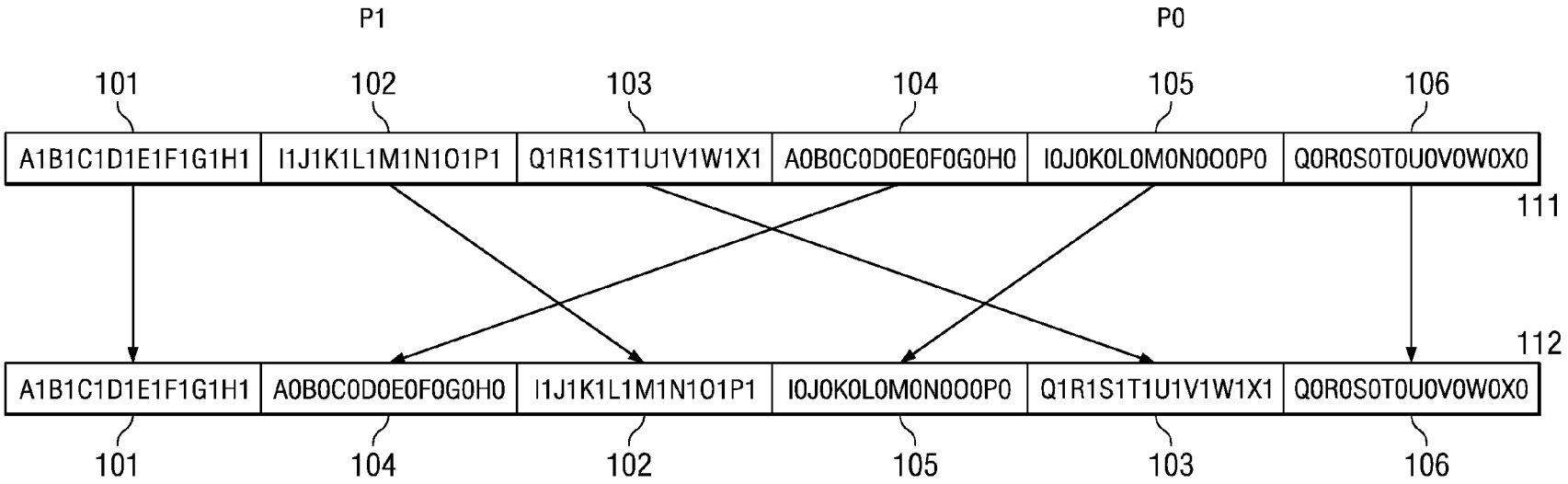
FIG. 2A illustrates the operation of a dual indexed direct memory access operation for color separation.

FIG. 2A shows an example of red, green and blue (RGB) color separation by using a DMA operation performed by DMA 22 in DSP 20. In this example, a DMA operation is performed by DMA 22 on pixels P1 and P0. Pixel P1 includes data bytes 101 (R), 102 (G) , and 103 (B). Pixel P0 includes data bytes 104 (R), 105 (G), and 106 (B). In reference to FIG. 2A, in some embodiments, DMA operations performed by DMA 22 can facilitate the corner turn function. DMA operations are performed by a DMA controller 22 contained on the DSP 20, which transfers data between address ranges in a memory 10 without intervention by the DSP's CPU. This DMA controller 22 can be used, for example, to separate and aggregate groups of bits at particular positions within data words. In some embodiments, the DMA 22 has a double-index addressing mode with parameters for the source and destination of the DMA that specify the frame and index for the transfer. A DMA transfer block consists of a number of frames. Each frame consists of elements that can have sizes of 8, 16, or 32 bits as follows:

transfer block size =number of frames * number of elements per frame * element size.

The number of frames, numbers of elements per frame, and size of elements are common for both the source and destination. However, the way in which the data is represented (addressing profile/mode) is independently programmable for the source and destination devices. With double index addressing, the address increases by the element size, plus the element index value less one within a frame. Once a full frame is transferred, the address increases by the element size plus the frame index value minus 1. DMA transfers using double index addressing are described in additional detail in the TMS320C645x DSP Enhanced DMA (EDMA3) Controller User's Guide, which is incorporated herein by reference. FIG.

2A illustrates the enhanced DMA operation for two 24-bit pixels, P1 and P0 residing in memory 10. For the sake of illustration, the pixel data is shown side-by-side but resides in memory in the same array as shown in FIG. 1B. As in FIG. 1B, each 24-bit word P1 and P0 represents data for an individual pixel in a display and comprises 8-bit groups for the primary colors of red, green, and blue. The DMA function can be used, for example, to separate each of the colors in frame data 111. For instance, if red is represented by the most significant 8 bits (101 and 104) of each pixel P1 and P0, the DMA function can separate red by writing the most significant 8-bits for each 24-bit word or pixel from source 111 to destination 112 in word order, as shown in FIG. 2A. The DMA function can do the same for each of the other colors in frame data 111. As a result, the most significant 16 bits at destination 112 represent all of the bits 101 and 104 representing red in frame data 111, the middle 16 bits 102 and 105 are green, and the least significant 16 bits 103 and 106 are blue. It should be noted that FIG. 2A is illustrative of two 24-bit words representing frame data. However, the DMA function and the method of this disclosure can be used for any number of words in memory. In this way, DMA functions can perform color separation. The above example can be implemented using the following parameters for the DMA controller of the TMS320C64x/C64x family of DSPs. These parameters are set assuming an HVGA resolution screen with 480 lines by 320 lines, or 153,600 pixel groups:

Addressing Mode: double index
Start Address: 1
Element Size: 1 (8-bit)
Number of elements per frame: 153,600
Element Index: 3
Number of frames: 1
Frame Index: 0

FIG. 2B shows the frame data 110 in memory 10, intermediate data structures 25, 26, and 28, and bit plane data 115. In reference to FIG. 2B, according to an embodiment of the present disclosure, the DMA function using DMA 22 described above can be used to perform the corner turn function. First, a DMA operation by DMA 22 can form 24 new bytes by grouping together bits of equal significance from each of the 8 pixels shown in 110. This can be accomplished by DMA 22 extracting the most significant bit from each of the 8 pixels, forming an intermediate byte 25. This new byte 25 is placed by DMA 22 in a new memory location 26, forming the first byte in bit plane 115. Next, the bits of the 8 pixels are shifted in memory 10, such that the most significant bit from each pixel is dropped. Another DMA operation is performed by DMA 22 to form another intermediate byte 27 comprising the current most significant bits of the pixels after the shift. This new byte 27 is placed next to the previously formed byte in memory location 26. This process is repeated until 24 new bytes are formed, with the last intermediate byte shown as 28. Once complete, bit plane 115 is formed. This is the same bit plane as discussed with respect to FIG. 2B. These operations have effectively corner turned the frame data comprising 8 pixels, such that each color for the frame is grouped together for display. In the event a display comprises more than 8 pixels, the above method is performed for each group of 8 pixels. Once complete, another DMA operation can be performed that will extract the most significant 8 bytes from each corner turned group of 8 pixels to extract the first color. These extracted 8 bytes are written to a new memory location. Another DMA operation is subsequently performed to extract the middle significant 8 bytes of the corner turned group to extract the next color. These extracted 8 bytes are placed next to the previous extracted bytes in memory. Finally, a third DMA operation is performed to extract the least significant 8 bytes of the corner turned group. This third group of extracted 8 bytes is placed next to the previous extracted 8-bytes. Altogether, these operations will effectively corner turn frame data comprising groups of 8-pixels, each pixel comprising 24-bits, each 24-bits comprising 3 groups of 8 bits, and each 8 bits comprising a color. It should be understood, however, that the embodiment described above is only one example of the disclosure, and that a person of ordinary skill in the art could readily use the above-described approach for pixels and displays of various sizes.

In some embodiments, DMA, pack, bitwise-shuffle, and dpack operations implemented by the DSP 20 and DMA 22 of FIG. 1A can be combined to perform the "corner turn" function shown in FIG. 1B. First, the DMA 22 can perform the DMA function and separate the color data contained in each word of the frame data. Next, DSP 20 can perform PACKH4 and PACKL4 operations on the color separated data. These operations separate the even numbered pixel words from the odd number pixel words. DSP 20 follows the execution of the pack instructions with two shuffle operations, which are performed on the resulting data. After the two shuffle operations, a DSP 20 performs a DPACK2 function and then an additional shuffle operation. In the case of red, green, and blue pixel data, this process is performed three times, once for each color. Once each color has gone through the process, a DMA operation is performed by DMA 22 to aggregate all groups of pixels into bit planes.

Figure 3:
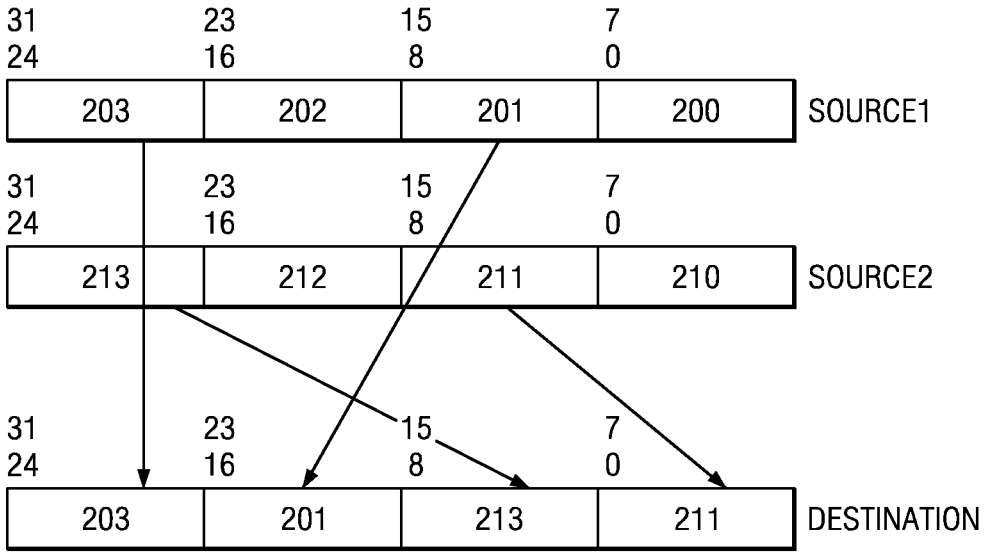
FIG. 3 (PRIOR ART)
FIG. 3 illustrates an instruction called PACKH4 or pack high in four parts.
Figure 4:
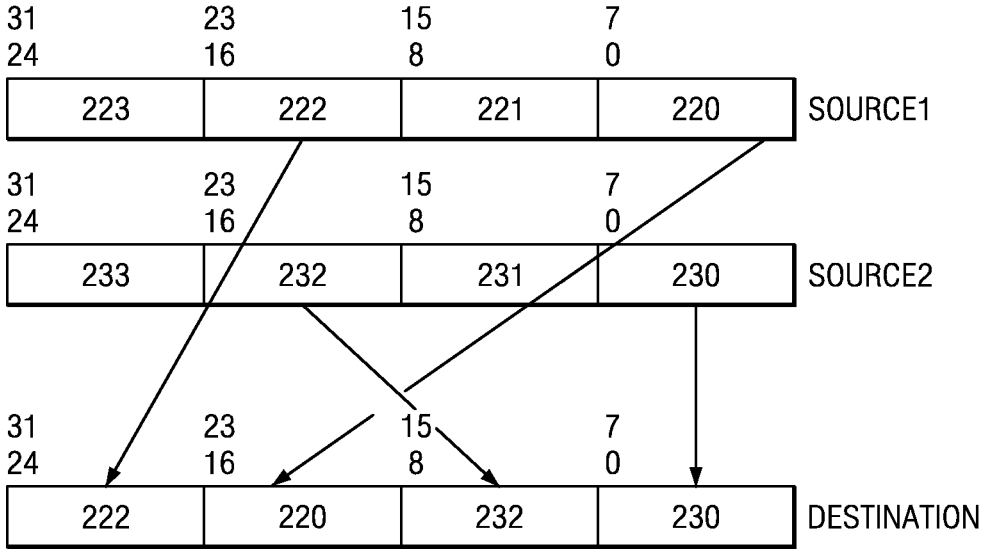
FIG. 4 (PRIOR ART)
FIG. 4 illustrates an instruction called PACKL4 or pack low in four parts.

FIGS. 3 and 4 illustrate two known data manipulation instructions that can be executed by DSP 20 called PACKH4 and PACKL4 (also called packing instructions) used in this disclosure. These instructions are available on the Texas Instruments TMS320C64x/C64x family of digital signal processors. FIG. 3 illustrates an instruction called PACKH4 or pack high in four parts. FIG. 3 shows four bytes of data 203, 202, 201, and 200 located in memory 10 at location Source1. FIG. 3, also shows four bytes of data 213, 212, 211, and 210 located in memory 10 at location Source2. FIG. 3 shows the execution of the PACKH4 instruction by DSP 20 on Source1 and Source2 resulting in the data structure at location "Destination." As illustrated in FIG. 3, this instruction takes the upper byte (8 bits) from each 16-bit word of the two source operands Source1 and Source2 and stores them in respective bytes of the destination operand. Specifically, the high byte 203 of the upper half-word of Source1 is moved to the upper byte of the upper half-word of the destination. The high byte 201 of the lower half-word of Source1 is moved to the lower byte of the upper half-word of the destination. The high byte 213 of the upper half-word of Source2 is moved to the upper byte of the lower half-word of the destination. The high byte 211 of the lower half-word of Source2 is moved to the lower byte of the lower half-word of the destination. A PACKH4 instruction for the operation in FIG. 3 can be written as follows:

PACKH4 source1, source 2, destination

FIG. 4 illustrates an instruction called PACKL4 or pack low in four parts. FIG. 4 shows four bytes of data 223, 222, 221, and 220 located in memory 10 at location Source1. FIG. 4 also shows four bytes of data 233, 232, 231, and 230 located in memory 10 at location Source2. FIG. 3 shows the execution of the PACKL4 instruction by DSP 20 on Source1 and Source2 resulting in the data structure at location Destination. The low byte 222 of the upper half-word of Source 1 is moved to the upper byte of the upper half-word of the destination. The low byte 220 of the lower half-word of source1 is moved to the lower byte of the upper half-word of the destination. The low byte 232 of the upper half-word of source2 is moved to the upper byte of the lower half-word of the destination. The low byte 230 of the lower half-word of source2 is moved to the lower byte of the lower half-word of the destination. A PACKL4 instruction for the operation in FIG. 4 can be written as follows:

PACKL4 source1, source 2, destination

Figure 5A:
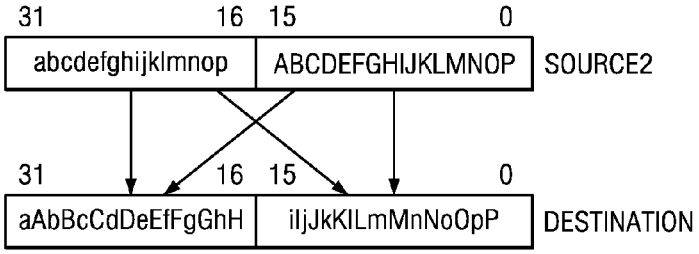
FIG. 5A illustrates an instruction called a SHFL or shuffle instruction.

FIG. 5A through FIG. 7 illustrate the operation of a shuffle instruction by DSP 20 on data structures residing in memory 10. FIG. 5A shows two 16-bit words side by side residing at "Source2" in memory 10. The data structure residing at memory location "Destination" shows the results of a shuffle operation executed by DSP 20 on the data structure located at Source 2. This shuffle instruction executed by DSP 20 resembles the shuffling of a deck of cards as the 16 most significant bits of Source2 are interleaved with the 16 least significant bits of Source2 into the "Destination."

Figure 5B:
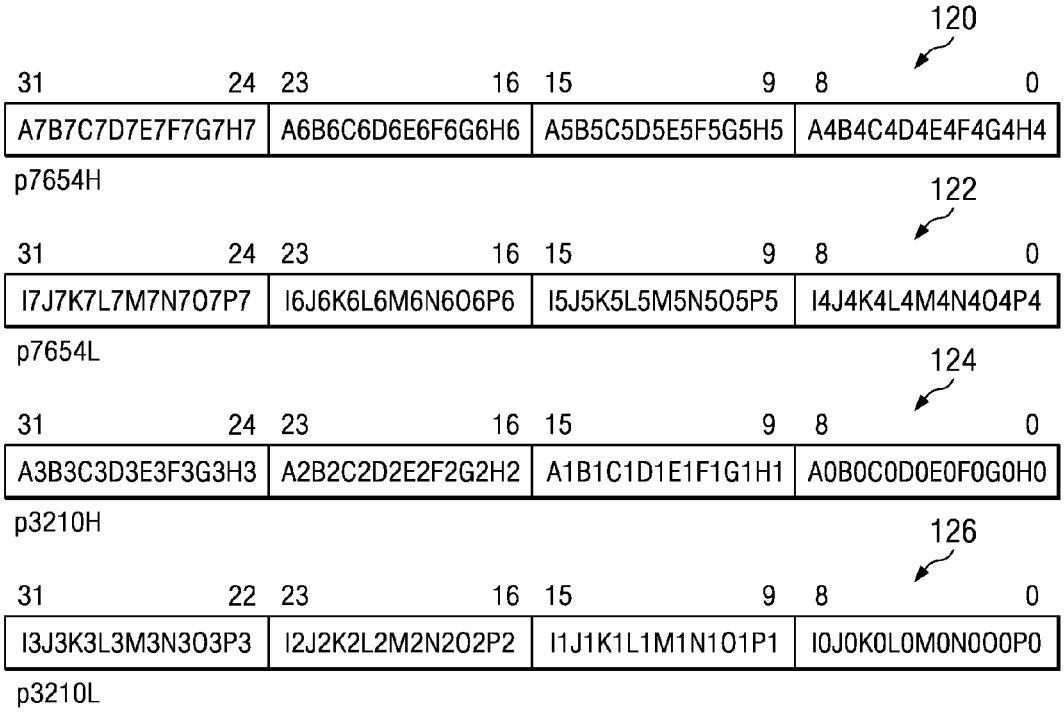
FIG. 5B illustrates an instruction called a SHFL or shuffle instruction.

FIG. 5B illustrates data structures 120, 122, 124, and 126 (not previously shown) that can reside in memory 10. Data structures 120, 122, 124, and 126 consist of four bytes of data each. The p7654H label beneath the data structures designates a memory location. With respect to FIG. 5B, each of four data structures 120, 122, 124, and 126 are shuffled using the example instructions as follows:

SHFL p7654H, p7654H1
SHFL p7654L, p7654L1
SHFL p3210H, p3210H1
SHFL p3210L, p3210L1

The above instructions command DSP 20 to interlace the most significant 16 bits of the pixel located in the memory location in the left field with the pixel's least significant 16 bits, and writing the result into the destination memory location designated in the right field. FIG. 6 illustrates the results of shuffling the four data word 120, 122, 124 and 126 of FIG. 5B, resulting in respective data words 130, 132, 134 and 136. FIG. 7 illustrates the results of DSP 20 executing a shuffle operation on data words 130, 132, 134 and 136 of FIG. 6, resulting in respective data words 140, 142, 144 and 146. The shuffle instructions on the data structures shown in FIG. 6 and FIG. 7 can be written as follows:

SHFL p7654H1, p7654H2
SHFL p7654L1, p7654L2
SHFL p3210H1, p3210H2
SHFL p3210L1, p3210L2

Figure 8:
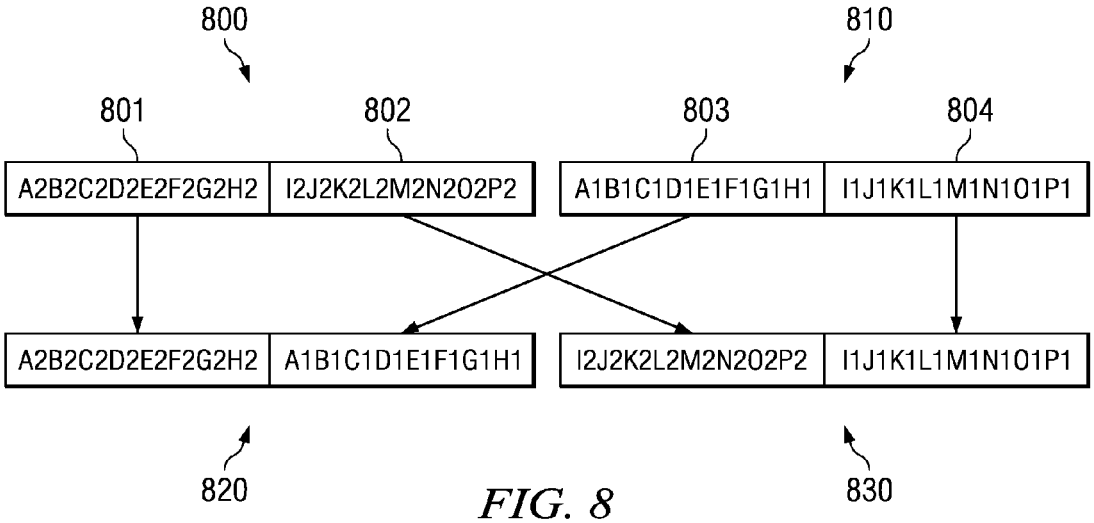
FIG. 8 illustrates the results of the DPACK2 instruction.

FIG. 8 shows four data structures 800, 810, 820, and 820 that can reside in memory 10. Data structure 800 is made of two bytes, 801 and 802. Data structure 810 is made of two bytes 803 and 804. Data structures 820 and 830 also comprise two bytes each and show the result of a DPACK2 instruction executed by DSP 20 on 800 and 810. The DPACK2 instruction (also called dpacking) executes a PACK2 instruction in parallel with a PACKH2 instruction. The PACK2 function of the DPACK2 instruction takes the lower halfword 802 from source 800 and the lower halfword 804 from source 810 and packs them both into destination 830. The lower halfword of source 800 is placed in the upper halfword of destination 830. The lower halfword of source 810 is placed in the lower halfword of destination 830. The PACKH2 function of the DPACK2 instruction takes the upper halfword 801 from source 800 and the upper halfword 803 from source 810 and packs them both into destination 830. The upper halfword 801 of source 800 is placed in the upper halfword of destination 830. The upper halfword 803 of source 810 is placed in the lower halfword of destination 830.

Figure 9:
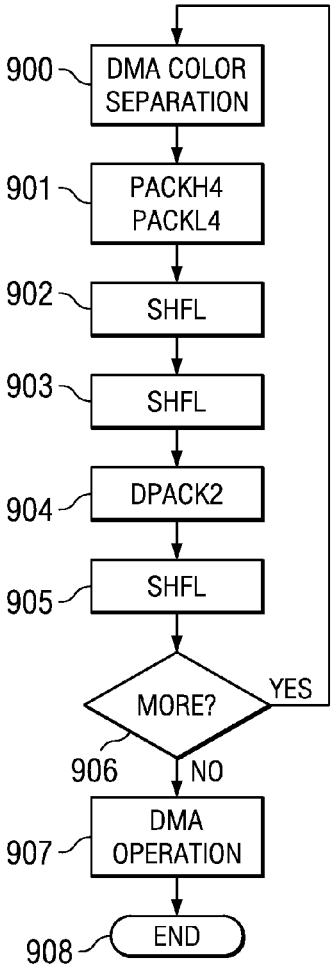
FIG. 9 illustrates a flow diagram of a sequence of DMA and DSP instructions.

Altogether, the DMA, pack, bitwise-shuffle, and dpack operations described above can be combined to perform the "corner turn" function shown in FIG. 1B-formatting frame data existing in memory to bit plane format for use by a digital mirror device (DMD). In some embodiments, the corner turn function of the present disclosure is illustrated in the block diagram shown in FIG. 9. FIG. 9 shows a series of operations that can be performed by DSP 20 and DMA 22 on frame data 110 to transform 110 into bit plane data 115, shown in FIG. 1B. First, a DMA operation is performed by DMA 22 at 900 for frame data in memory 10, such as 110. The DMA function separates the color data contained in each word of the frame data, such as described with respect to FIG. 2A. Next, PACKH4 and PACKL4 operations are performed by DSP 20 at 901 on the color separated data. These operations separate the even numbered pixel words from the odd numbered pixel words. At 903 and 904, two shuffle operations are performed by DSP 20 on the resulting data. After the two shuffle operations, a DPACK2 function is performed by DSP 20 at 904 followed by an additional shuffle 905. At 906, the DSP checks if there are more groups of 8 pixels to planarize and the process is repeated. Once steps 900 through 906 are completed for a color for all of the groups of 8 pixels, a DMA operation is performed by DMA 22 at 907 to aggregate words of equal significance from each sorted pixel group into bit planes. In addition, in the case of red, green, and blue pixel data, the process from 900 to 907 is performed three times by DSP 20, once for each color.

Additional detail of the corner turning algorithm of the present disclosure is described with reference to FIG. 10. In FIG. 10, the pixel data 110 of Figure 1B is shown as a single row for purposes of illustration, but resides in memory as the array shown in Figure 1B. The ellipses are used to signify the presence of Pl, P2, P3, P4, P5, and P6. As previously discussed, data structure 110 comprises eight 24-bit data words of 8 pixels. According to an embodiment of the present disclosure, first, an enhanced DMA operation 900 is performed by DMA 22 on 110, resulting in the data structure 1001. The DMA function utilizes dual index addressing, allowing the most significant 8 bits of each 24-bit word to be extracted and written in word order in a new memory location 1001. For example, the most significant 8 bits of P7 are written into the most significant byte of 1001. This is followed by the most significant 8 bits of P6, P5, P4, P3, P2, P1, and P0. Because the most significant byte of each pixel is data for the color red, the DMA operation executed by DMA 22 has separated the red color data from 110 into the new data structure 1001.

After color separation is performed using by DMA 22, the next step in performing the corner turn function is the execution of the PACKH4 and PACKL4 operation by DSP 20 on data 1001. This step 901 is shown in FIG. 10. The PACKH4 instruction commands the DSP 20 to take the high order byte from each 16-bit word (A7 to H7, A5 to H5, A3 to H3, A1 to H1) and place the extracted high order bytes in word order into a new memory location 1002. This results in the 4 bytes in 1002 being the most significant byte of each 16-bit word (A7 to H6, A5 to H4, A3 to H2, A1 to H0). The PACKL4 instruction commands the DSP 20 to place the lower order byte from each 16-bit word (A6 to H6, A4 to H4, A2 to H2, A0 to H0) and place them in word order into a new memory location 1003. This results in the 4 bytes in 1003 being the least significant byte of each 16-bit word(A7 to H6, A5 to H4, A3 to H2, A1 to H0). Next, two SHFL operations are performed by DSP 20 at 902 and 903, twice interleaving an 8-bit pair with the next consecutive 8-bit pair. Following the SHFL operations, a DPACK2 instruction is executed by DSP 20 at 904, reordering the 16-bit pairs. Another SHFL operation is performed at 905. As shown in FIG. 10, this sequence of operations has taken frame data that was originally structured as 24-bit three color pixel data and transformed it to contiguous bits of a single color. In this example, bits A through H for each of the 8 pixels was the red color data. The above operations 900 through 905 create a new data structure with the red color data from each of the 8 pixels placed in a contiguous sequence in their original word order, shown in 1005 ("turned data"). In some embodiments the above steps 900-905 are performed for additional groups of 8 pixels in the frame data, resulting in "turned data" or a data structure similar to 1005 for each group of 8 pixels. When multiple groups of 8 pixels are operated on, a DMA operation is performed by DMA 22 at 907, which gathers the first word of each "turned data" structure and places them in sequence, as shown in 1006 of FIG.10.

Sequence 900 through 905 can be repeated for any number of 8 pixel groups in a DMD device. If multiple numbers of 8 pixel groups are processed, the DMA operation shown at 907 can be used to aggregate each byte for each color in the order of their significance. For instance, the DMA operation will gather and aggregate the most significant bytes for red for each group of 8 pixels. Once the most significant red bytes are gathered from each 8 pixel group, the second most significant bytes for red are gathered, and so on. In the event 64 pixels are used, resulting in 8 different groups of 8 pixels, the ultimate result of the DMA operation 907 is shown in data structure 1006. The most significant bits for the color red, signified by A, are arranged in a data structure in pixel order from P63 to P0. The DMA operation will create additional data structures for bits B through X, assuming 24-bit pixel data.

With respect to performance, an embodiment of the present disclosure can have the following properties. In some embodiments, such as when the present application is implemented in the Texas Instruments TMS320C64x/C64x DSPs using the DSP operations discussed above, the effective bandwidth for the DMA can be 320 megabytes per second using 133 megahertz double data rate (DDR) memory and number of DSP cycles per pixel can be 2.56. For corner turning at HVGA resolution, or 480 by 320 pixels, the total performance can be calculated as follows. Color separation using the DMA (shown as step 900 in FIG. 9) can take 1.4 milliseconds. This is calculated by taking the total number of bytes in a frame and dividing by the bandwidth of the DMA. In this case, the total number of bytes in a frame are 3-bytes per pixel group multiplied by 153600 pixel groups (480 rows multiplied by 320 columns). Dividing this product by the DMA bandwidth of 320 megabytes per second gives 1.4 milliseconds. Next, the time for DSP operations (steps 901 to 905 in FIG. 9) can take 4.4 milliseconds. This is calculated by taking the total number of DSP cycles required to be processed by a frame and dividing by the operational frequency of the TMS320C64x/C64x Family of DSPs, about 266 megahertz. The total cycles are 2.56 cycles per pixel multiplied by 460800 pixels, or 1179648 cycles. Therefore, the amount of time to process these cycles is 1179648 cycles divided by 266 megahertz, or 4.4 milliseconds. Finally, the another DMA operation (step 907 in FIG. 9) will also take the same 1.4 milliseconds as described with respect to the color separation. Therefore, the total time for processing a 480 by 320 HVGA resolution frame is 1.4 ms+4.4 ms+1.4 ms, or 7.2 ms per frame.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. For example, it will be understood that although a particular embodiment may apply the present disclosure to 24-bit pixel data, the present disclosure may be used with other sizes of pixel data.

What is claimed is:

1. A method for converting image pixel color data organized in a frame data format into image pixel color data organized in a bit plane format, comprising:

a) loading the image pixel color data in frame data format into memory at a first memory address, the loaded data at a first location comprising a sequence of n bits of data for each of three different colors for each of p different pixels having pixel numbers;

b) using a direct memory access controller for each group of 8 pixels forming color separated pixel data by for a first of the three colors, for pixels i=1 to i=8 recalling n bits of data stored at the first memory address of the group of 8 pixels plus 3n(i−1), storing said n bits of data at a second memory address for the group of 8 pixels plus n(i−1), thereby forming first color separated data, for a second of the three colors, for pixels i=1 to i=8 recalling n bits of data stored at the first memory address of the group of 8 pixels plus 3n(i−1)+n, storing said n bits of data at a second memory address for the group of 8 pixels plus 8p+n(i−1), thereby forming second color separated data, for a third of the three colors, for pixels i=1 to i=8 recalling n bits of data stored at the first memory address of the group of 8 pixels plus 3n(i−1)+2n, storing said n bits of data at a second memory address for the group of 8 pixels plus 16p+n(i−1), thereby forming third color separated data;

c) using a digital signal processing operation for each group of 8 pixels of each color of said color separated pixel data forming even/odd pixel number separated pixel data by selecting data for even pixels by repeated performing a PACKH4 instruction on a current one of said first, second and third color separated pixel data, each PACKH4 instruction forming an output having a most significant n bits corresponding to a most significant n bits of a first 4 pixels of said current color separated pixel data, a second most significant n bits corresponding to a third most significant n bits of said first 4 pixels of said current color separated pixel data, a third most significant n bits corresponding to a most significant n bits of a second 4 pixels of said color separated pixel data, a fourth most significant n bits corresponding to a third most significant n bits of said second 4 pixels of said current color separated pixel data, selecting data for odd pixels by repeated performing a PACKL4 instruction on said current one of said first, second and third color separated pixel data, each PACKL4 instruction forming an output having a most significant n bits corresponding to a second most significant n bits of a said first 4 pixels of said current color separated pixel data, a second most significant n bits corresponding to a fourth most significant n bits of said first 4 pixels of said current color separated pixel data, a third most significant n bits corresponding to a second significant n bits of said second 4 pixels of said current color separated pixel data, a fourth most significant n bits corresponding to a fourth most significant n bits of said second 4 pixels of said current color separated pixel data;

d) using a digital signal processing operation for each group of 8 pixels of each color of said color separated pixel data forming first shuffled pixel data by a shuffle instruction on 4n bit portions of the color separated pixel data, each shuffle instruction forming an output interleaving a bit from a most significant half of a portion of an input with a bit from a least significant half of a portion of said input;

e) using a digital signal processing operation for each group of 8 pixels of each color of said first shuffled pixel data forming second shuffled pixel data by a shuffle instruction on 4n bit portions of the first shuffled pixel data;

f) using a digital signal processing operation for each group of 8 pixels on each color of said second shuffled pixel data forming packed data by a DPACK2 instruction, each DPACK2 instruction forming a first 4n bit data word having a most significant 2n bits corresponding to a most significant 2n bits of a first 4n bit operand data word of said second shuffled pixel data and a least significant 2n bits corresponding to 2n most significant bits of a second 4n bit operand data word of said second shuffled pixel data and forming a second 4n bit data word having a most significant 2n bits corresponding to a least significant 2n bits of said first 4n bit data word of said second shuffled pixel data and a least significant 2n bits corresponding to 2n least significant bits of a second 4n bit data word of said second shuffled pixel data;

g) using a digital signal processing operation for each group of 8 pixels of each color of said packed pixel data forming third shuffled pixel data by a shuffle instruction on 4n bit portions of the packed pixel data; and h) following execution of steps a) to g) on all groups of 8 pixels of a video frame, using a direct memory access controller for each group of 8 pixels of each color packed pixel data pixels to i) recall n bits of data for most significant bits of the first color and store said most significant bits consecutively, ii) recall n bits of data for next most significant bits of the first color and store said next most significant bits consecutively, iii) repeat step ii) for each of said n bits of the first color, iv) recall n bits of data for most significant bits of the second color and store said most significant bits consecutively, v) recall n bits of data for next most significant bits of the second color and store said next most significant bits consecutively, vi) repeat step ii) for each of said n bits of the second color, vii) recall n bits of data for most significant bits of the third color and store said most significant bits consecutively, viii) recall n bits of data for next most significant bits of the third color and store said next most significant bits consecutively, and ix) repeat step ii) for each of said n bits of the third color.

2. The method of claim 1, wherein:

n equals 8.

3. The method of claim 1, wherein:

the frame data comprises 480 pixels by 320 pixels.

* * * * *